US008267732B1

(12) United States Patent
Poirier et al.

(10) Patent No.: US 8,267,732 B1
(45) Date of Patent: Sep. 18, 2012

(54) MARINE DRIVE LOWER GEARCASE WITH EFFICIENT LUBRICANT LEVEL

(75) Inventors: Randall J. Poirier, Howards Grove, WI (US); John A. Tuchscherer, Oshkosh, WI (US); Thomas S. Lonnborg, Fond du Lac, WI (US)

(73) Assignee: Brunswick Corporation, Lake Forest, IL (US)

( * ) Notice: Subject to any disclaimer, the term of this patent is extended or adjusted under 35 U.S.C. 154(b) by 176 days.

(21) Appl. No.: 12/899,698

(22) Filed: Oct. 7, 2010

(51) Int. Cl.
*B63H 20/32* (2006.01)
*B63H 21/36* (2006.01)

(52) U.S. Cl. ..... 440/76

(58) Field of Classification Search ..... 440/49, 440/66, 75, 76–78, 88 R, 88 L, 83, 86
See application file for complete search history.

(56) References Cited

U.S. PATENT DOCUMENTS 3,896,757 A * 7/1975 Kucher ..... 440/58
4,373,922 A 2/1983 Weed
4,792,313 A 12/1988 Meisenburg

* cited by examiner

*Primary Examiner* — Daniel Venne
(74) *Attorney, Agent, or Firm* — Andrus, Sceales, Starke & Sawall, LLP

(57) ABSTRACT

A marine drive having a lower gearcase with a vertical drive shaft driving a horizontal propeller shaft in a torpedo housing has a vent plug setting the level of lubricant in the lower gearcase to be substantially at the top of the torpedo housing.

15 Claims, 4 Drawing Sheets

MARINE DRIVE LOWER GEARCASE WITH EFFICIENT LUBRICANT LEVEL

BACKGROUND AND SUMMARY

The invention relates to marine drive lower gearcases with a vertical drive shaft driving a horizontal propeller shaft in a housing and having a propeller mounted on the propeller shaft at the rear of the torpedo housing.

A marine drive lower gearcase, including sterndrives and outboards, includes a torpedo housing with an internal cavity holding lubricant for lubricating gears and bearings in the gearcase.

The present invention arose during continued development efforts in the above technology.

BRIEF DESCRIPTION OF THE DRAWINGS

FIG. 1 is a sectional view of a portion of a marine drive lower gearcase and torpedo housing with an internal lubricant containing cavity and drain plug location known in the prior art.

FIG. 2 is a sectional view of a marine drive lower gearcase and torpedo housing with drain plug location in accordance with the noted '313 patent.

FIG. 3 is an enlarged view of a portion of FIG. 2.

FIG. 4 is a sectional view taken along line 4-4 of FIG. 3.

DETAILED DESCRIPTION

Description of Prior Art

Figure 1:
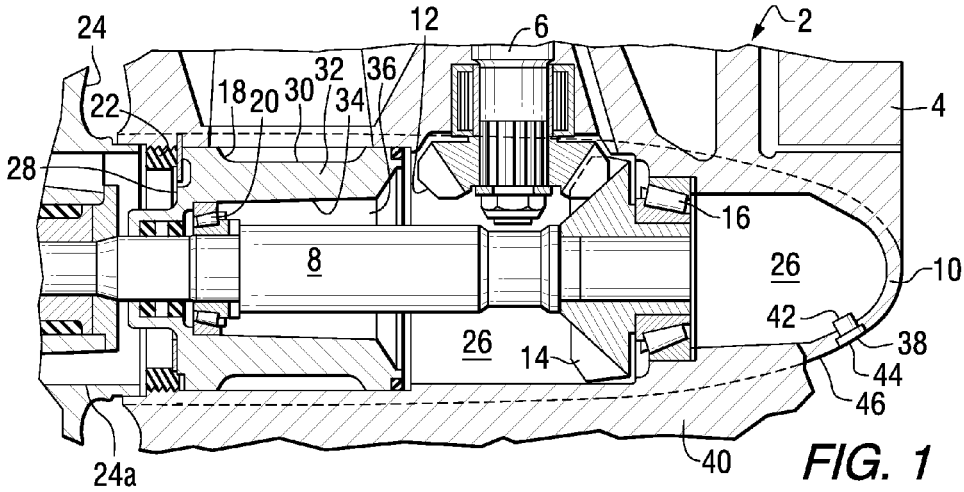
FIG. 1 PRIOR ART
FIGS. 1-4 are taken from U.S. Pat. No. 4,792,313, incorporated herein by reference.

The following description of FIGS. 1-4 is taken from the noted incorporated '313 patent, and like reference numerals are used to facilitate understanding.

FIG. 1 shows a marine drive 2 having a lower gearcase 4 with a vertical drive shaft 6 driven by an internal combustion engine (not shown) and driving a horizontal propeller shaft 8 in a torpedo housing 10. Beveled pinion gear 12, splined to the bottom of drive shaft 6, drives drive gear 14, which is splined to propeller shaft 8. Propeller shaft 8 is supported for rotation at its front end by tapered roller bearings 16, and is supported for rotation near its rear end by spool 18 and roller bearings 20. Spool 18 is mounted to the rear of the torpedo housing and retained within the torpedo housing by spool nut 22. Propeller 24 is mounted on propeller shaft 8 at the rear of the torpedo housing. Torpedo housing 10 has an internal cavity 26 holding lubricant for lubricating the gears and bearings. Spool 18 has a rear portion 28 facing propeller 24 rearwardly thereof and supporting propeller shaft 8 for rotation at tapered roller bearings 20. Spool 18 has a forward portion 30 extending forwardly into cavity 26. The spool includes an annular side wall 32 having an inner surface 34 spaced outwardly from propeller shaft 8 by an annular gap 36. Annular gap 36 is part of and communicates with internal cavity 26 to thus provide lubricant to tapered roller bearings 20.

A removable threaded drain plug 38 is provided through the torpedo housing near the nose thereof and slightly offset to the side of lower skeg 40. Drain plug 38 is received in threaded bore 42, and the enlarged head of drain plug 38 is received in counterbore 44. Plug 38 is removed by unscrewing it from the bore. The hole through the torpedo housing sidewall disrupts the exterior hydrodynamic surface 46 of the torpedo housing along which water flows. This in turn causes cavitation burns on the torpedo housing immediately downstream of the drain plug hole, and also on the propeller. This also contributes to propeller ventilation.

Figure 2:
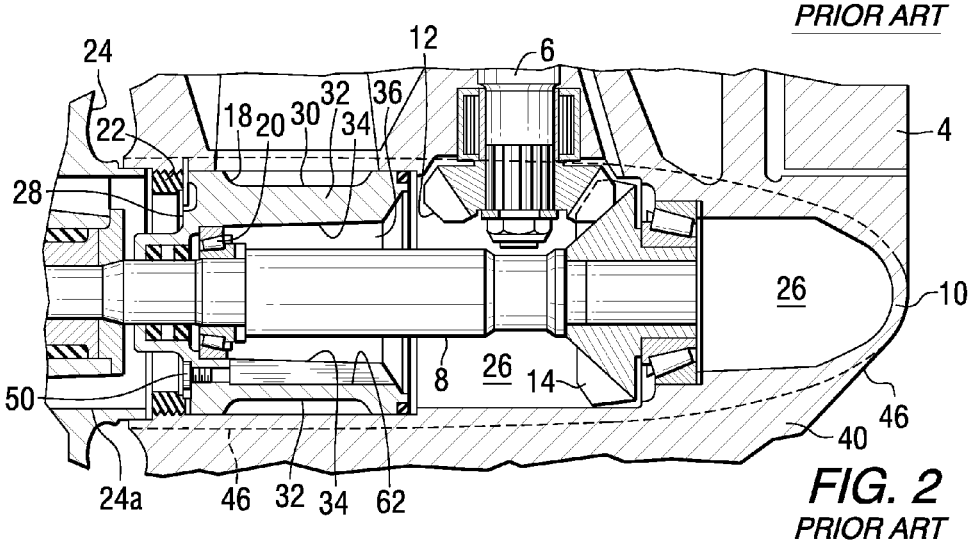
FIG. 2 PRIOR ART
Figure 3:
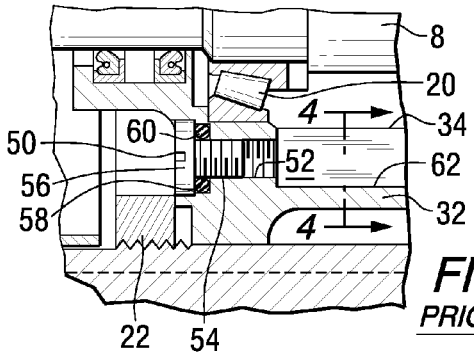
FIG. 3 PRIOR ART
Figure 4:
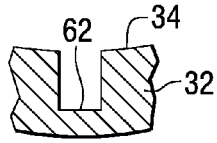
FIG. 4 PRIOR ART

FIGS. 2-4 show a marine drive lower gearcase and drain plug location in accordance with the noted '313 patent, and like reference numerals are used from FIG. 1 where appropriate to facilitate clarity. Removable drain plug 50 is provided in the torpedo housing at the rear thereof for draining lubricant upon removal of the plug. The drain plug is mounted at a location away from the exterior hydrodynamic surface of the torpedo housing to prevent cavitation burns on the torpedo housing and the propeller otherwise caused by mounting the drain plug at the hydrodynamic surface as in FIG. 1. The rear portion 28 of spool 18 has a threaded bore 52, FIG. 3, extending forwardly therethrough. Drain plug 50 has a threaded shank portion 54 threaded into bore 52, and an enlarged head portion 56 bearing against 0-ring seal 58 in counterbore 60. Inner surface 34 of annular side wall 32 of spool 18 has a groove 62, FIG. 4, therein axially aligned with bore 52. Drain plug 50 is removed rearwardly by unscrewing it from bore 52, permitting drainage of lubricant from cavity 26 through annular gap 36 and along groove 62 and out through bore 52.

Water flows rearwardly along the outer perimeter hydrodynamic surface 46 of the torpedo housing. Drain plug 50 is mounted at the rear of the torpedo housing and extends forwardly thereinto. The drain plug and its mounting bore are spaced laterally inwardly of exterior outer perimeter hydrodynamic surface 46 of the torpedo housing, to prevent cavitation burns on the torpedo housing and the propeller, and to aid in eliminating propeller ventilation. Drain plug 50 is laterally between propeller shaft 8 and outer perimeter hydrodynamic surface 46, and is forward of propeller 24.

Drain plug 50 is accessed from the rear. Propeller 24 has a hub **24*a* with an outer perimeter having a laterally outward extent beyond drain plug 50 to cover the latter. In one embodiment, propeller 24 is removed from propeller shaft 8 to provide access to drain plug 50. In another embodiment with a propeller having a hub with through-hub exhaust passages extending rearwardly therethrough in an annulus around the propeller shaft, for example as shown in U.S. Pat. Nos. 4,178,873 and 3,871,324, incorporated herein by reference, drain plug 50 is accessed through one of the exhaust passages. In this latter embodiment, head 56 of drain plug 50** may have to be laterally reduced in size in order to provide clearance through the exhaust passage through the propeller hub.

Figure 5:
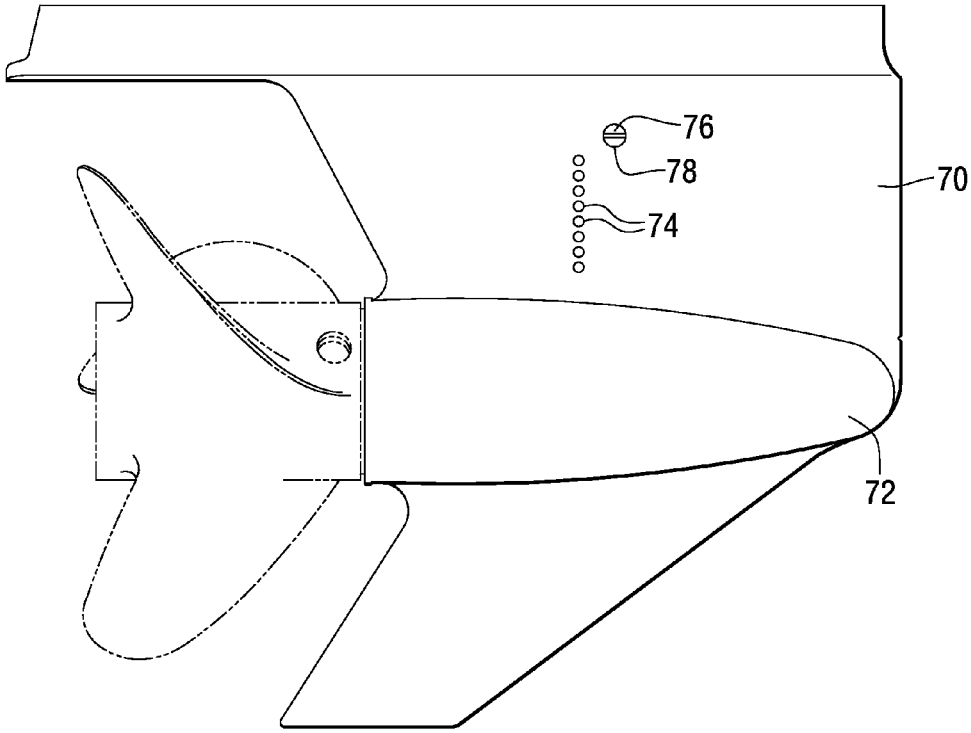
FIG. 5 PRIOR ART
FIG. 5 is a side view of a marine drive lower gearcase showing a vent plug location known in the prior art.

FIG. 5 shows a marine drive lower gearcase 70 including torpedo housing 72 and having water inlets 74 in the gearcase portion above the torpedo housing for admitting cooling water into the gearcase which water is then pumped upwardly to cool the internal combustion engine (not shown). Threaded vent plug screw 76 is on the side of the gearcase above the water inlets. The gearcase is filled with lubricant by removing threaded drain plug 38 of FIG. 1 or 50 of FIG. 2 and removing threaded vent plug 76, and then introducing lubricant into bore 44 or bore 52 until the lubricant flows out of the now open bore or port 78.

Present Application

Figure 6:
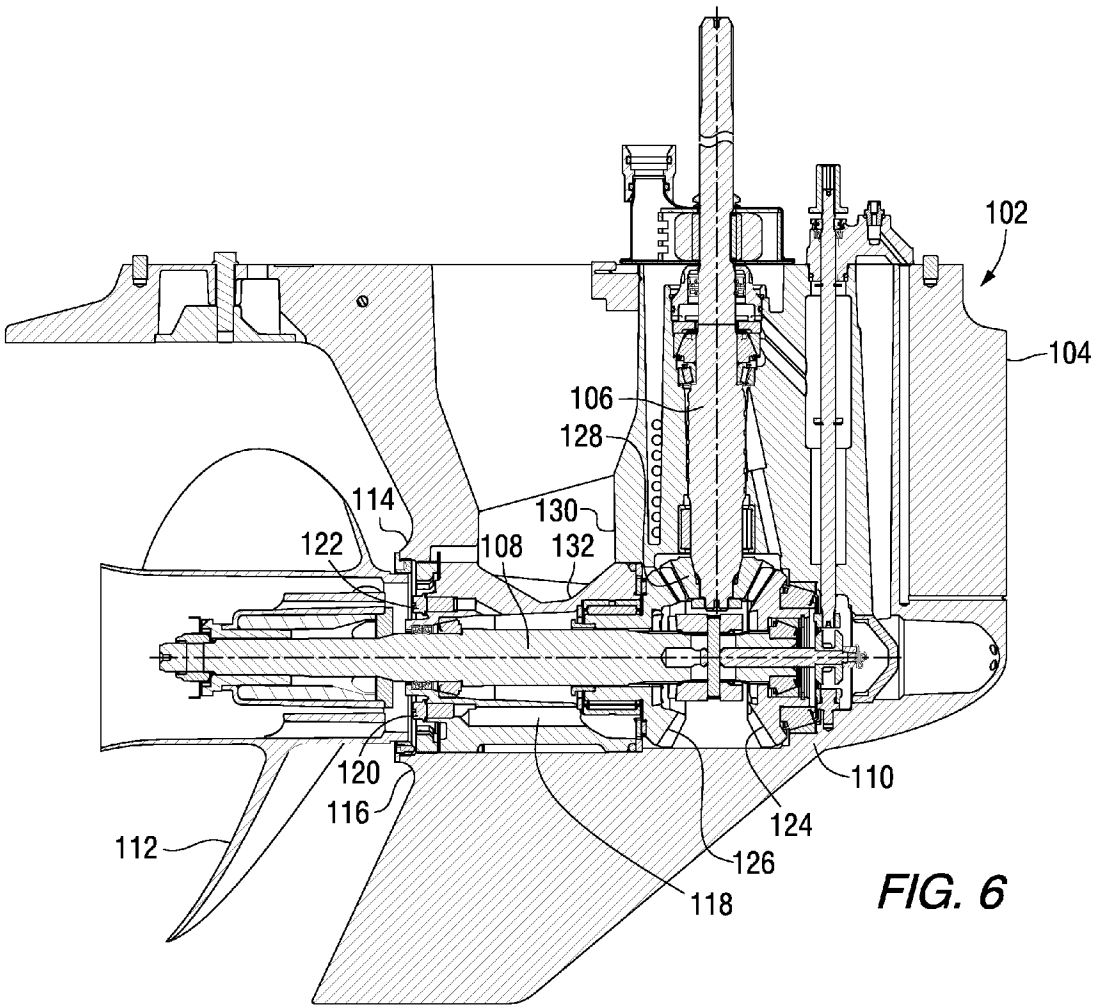
FIG. 6 is a sectional view of a marine drive lower gearcase including torpedo housing with vent plug location in accordance with the present invention.
Figure 7:
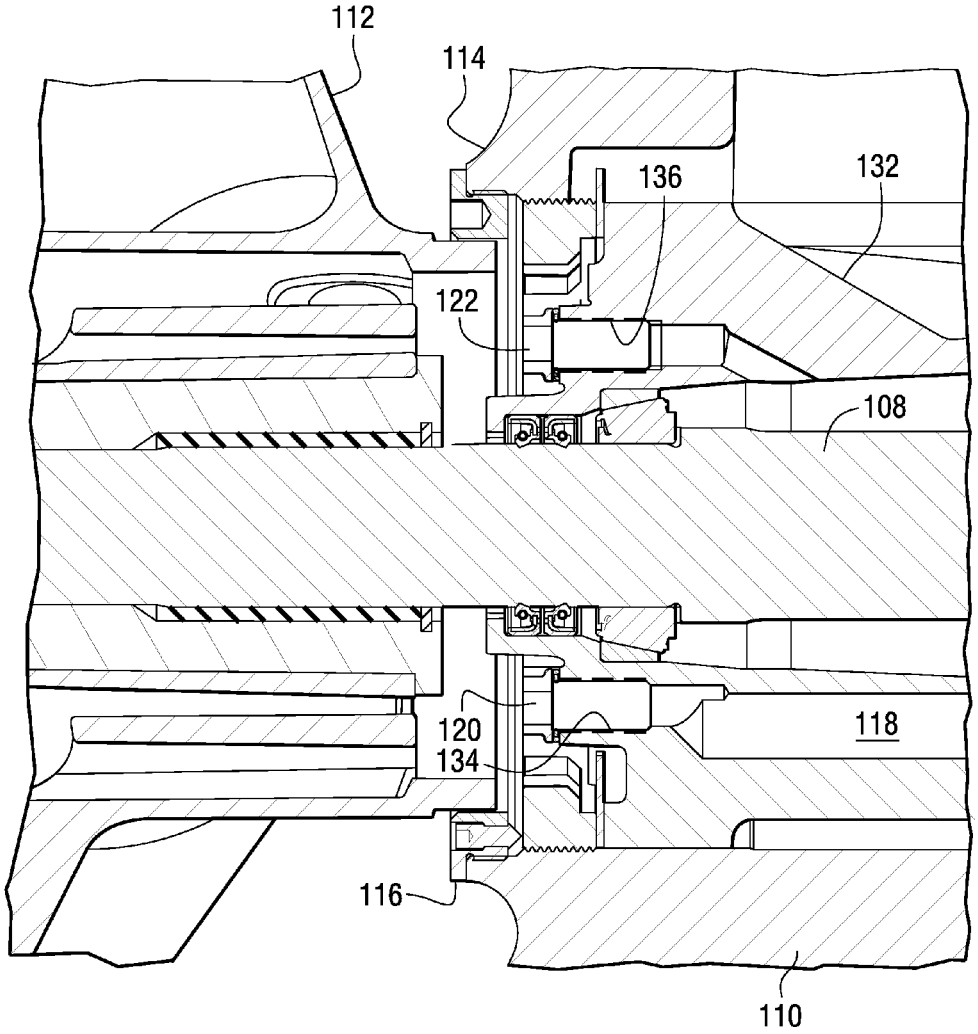
FIG. 7 is an enlarged view of a portion of FIG. 6.

FIGS. 6 and 7 show a marine drive 102 having a lower gearcase 104 with a vertical drive shaft 106 driving a horizontal propeller shaft 108 in a torpedo housing 110 and having a propeller 112 mounted on the propeller shaft at the rear of the torpedo housing. The torpedo housing has a top 114 and a bottom 116 and an internal cavity 118 holding lubricant. A removable threaded drain plug 120 is provided comparably to drain plug 50 noted above. A removable threaded vent plug 122 sets the level of lubricant in the lower gearcase to be substantially at the top of the torpedo housing. The torpedo housing houses forward and reverse drive gears 124 and 126 driven by drive shaft 106 at lower pinion gear 128, as is known. The lower gearcase has a drive shaft housing portion 130 extending upwardly from the top of the torpedo housing. Vent plug 122 controls and lowers the level of lubricant in the gearcase to be substantially at the top of the torpedo housing and below the drive shaft housing portion 130, to reduce excessive lubricant churning created by one or more drive gears such as 124, 126 churning through lubricant, and concordantly reduce heat, power loss and foaming of lubricant otherwise caused thereby.

In one embodiment, vent plug 122 is at the rear of torpedo housing 110 proximate the top 114 thereof. The torpedo housing has an exterior hydrodynamic surface along which water flows rearwardly, i.e. right to left in FIGS. 1, 2, 5, 6. In this embodiment, vent plug 122 is mounted to the torpedo housing at a location away from such hydrodynamic surface to prevent cavitation burns. Water flows rearwardly along the outer perimeter hydrodynamic surface of the torpedo housing, and vent plug 122 and drain plug 120 are each spaced laterally inwardly of the noted outer perimeter hydrodynamic surface of the torpedo housing, and in one embodiment at the rear of the torpedo housing between propeller shaft 108 and the noted outer perimeter hydrodynamic surface, and forward of propeller 112. The torpedo housing includes a bearing carrier or spool 132, comparable to above noted spool 18, and supporting the propeller shaft for rotation. Vent plug 122 and drain plug 120 each engage bearing carrier 132 in threaded relation at the rear thereof. In this embodiment, drain plug 120 and vent plug 122 are distally opposite each other, with drain plug 120 being proximate the bottom of the torpedo housing, and vent plug 122 being proximate the top of the torpedo housing.

The present system provides a method for reducing heat, power loss and foaming of lubricant in a marine drive having a lower gearcase with a vertical drive shaft driving a horizontal propeller shaft in a torpedo housing and having a propeller mounted on the propeller shaft at the rear of the torpedo housing. The method involves providing a vent plug 122 setting the level of lubricant in the lower gearcase, and moving the vent plug from a position otherwise located at the noted drive shaft housing portion, e.g. as shown at 76 in FIG. 5, to a location as shown in FIGS. 6, 7 at torpedo housing 110. Vent plug 122 at the rear of the torpedo housing proximate the top 114 thereof lowers the level of lubricant in the gearcase to be substantially at the top of the torpedo housing and below the drive shaft housing portion 130.

The filling method of the present system involves removing both the drain plug 120 and the vent plug 122 leaving respective exposed drain and vent ports 134 and 136 in the torpedo housing, and then introducing lubricant through the drain port 134 into the internal cavity 118 to flow around the drive gears such as 124, 126, until the lubricant flows out of the vent port 136 and without filling the drive shaft housing portion 130 thereabove with the lubricant. The drain plug 120 is removed by turning it out of threaded engagement with bearing carrier 132, and the vent plug 122 is removed by turning it out of threaded engagement with bearing carrier 132. After lubricant fill, the drain plug and vent plug are re-installed by turning each into its respective threaded engagement with respective ports 134 and 136.

In one embodiment when used in conjunction with a 300 hp (horsepower) internal combustion engine, a 7 hp power increase was observed, resulting in a one mile per hour increase in top speed, thus evidencing reduction of power loss otherwise caused by excessive oil churning of submerged gears such as 124, 126 in lubricant. The noted churning also can create excessive heat, which in turn may otherwise require high cost synthetic lubricant to be used, particularly for higher pitch line velocities of the gears. The heat reduction facilitated by the present system desirably enables use of conventional lubricant without the necessity of the noted higher cost synthetic lubricant. In a further desirable advantage, the system reduces lubricant pressure, and accordingly increases seal life.

In the foregoing description, certain terms have been used for brevity, clearness, and understanding. No unnecessary limitations are to be inferred therefrom beyond the requirement of the prior art because such terms are used for descriptive purposes and are intended to be broadly construed. The different configurations, systems, and method steps described herein may be used alone or in combination with other configurations, systems and method steps. It is to be expected that various equivalents, alternatives and modifications are possible within the scope of the appended claims. Each limitation in the appended claims is intended to invoke interpretation under 35 U.S.C. §112, sixth paragraph, only if the terms "means for" or "step for" are explicitly recited in the respective limitation.

What is claimed is:

1. A marine drive comprising a lower gearcase with a vertical drive shaft driving a horizontal propeller shaft in a torpedo housing having a front and rear and having a propeller mounted on said propeller shaft at the rear of said torpedo housing, said torpedo housing having a top and a bottom and an internal cavity holding lubricant, said lubricant having an upper surface at a given level in said lower gearcase, a vent plug having a discharge condition to discharge lubricant from said internal cavity such that said given level of said lubricant in said lower gearcase is substantially at the top of said torpedo housing, wherein said torpedo housing houses at least one drive gear therein driven by said drive shaft, said lower gearcase has a drive shaft housing portion extending upwardly from the top of said torpedo housing, wherein said discharge of lubricant enabled by said vent plug lowers the level of lubricant in said lower gearcase to be substantially at the top of said torpedo housing and below said drive shaft housing portion, to reduce excessive lubricant churning created by said drive gear churning through lubricant, and concordantly reduce heat, power loss and foaming of lubricant otherwise caused thereby.

2. The marine drive according to claim 1 wherein said vent plug is at the rear of said torpedo housing proximate the top thereof.

3. The marine drive according to claim 2 wherein said torpedo housing has an exterior hydrodynamic surface along which water flows, and said vent plug is mounted to said torpedo housing at a location away from said hydrodynamic surface to prevent cavitation burns.

4. The marine drive according to claim 3 wherein said torpedo housing has an outer perimeter hydrodynamic surface along which water flows rearwardly, and wherein said vent plug is spaced laterally inwardly of said outer perimeter hydrodynamic surface.

5. The marine drive according to claim 4 wherein said vent plug is mounted at the rear of said torpedo housing between said propeller shaft and said outer perimeter hydrodynamic surface, and forward of said propeller.

6. The marine drive according to claim 5 wherein said torpedo housing includes a bearing carrier mounted therein and supporting said propeller shaft for rotation, and said vent plug engages said bearing carrier in threaded relation at the rear thereof.

7. A marine drive comprising a lower gearcase with a vertical drive shaft driving a horizontal propeller shaft in a to torpedo housing having a front and rear and having a propeller mounted on said propeller shaft at the rear of said torpedo housing, said torpedo housing having a top and a bottom and an internal cavity holding lubricant, said lubricant having an upper surface at a given level in said lower gearcase, a vent plug having a discharge condition to discharge lubricant from said internal cavity such that said given level of said lubricant in said lower gearcase is substantially at the top of said torpedo housing, wherein:

said torpedo housing houses at least one drive gear therein driven by said drive shaft;

said lower gearcase has a drive shaft housing portion extending upwardly from the top of said torpedo housing;

said discharge of lubricant enabled by said vent plug lowers the level of lubricant in said gearcase to be substantially at the top of said torpedo housing and below said drive shaft housing portion, to reduce excessive lubricant churning created by said drive gear churning through lubricant, and concordantly reduce heat, power loss and foaming of lubricant otherwise caused thereby;

said vent plug is at the rear of said torpedo housing proximate the top thereof;

said torpedo housing has an outer perimeter hydrodynamic surface along which water flows rearwardly;

said vent plug is mounted to said torpedo housing at a location away from said outer perimeter hydrodynamic surface to prevent cavitation burns;

said vent plug is spaced laterally inwardly of said outer perimeter hydrodynamic surface;

said vent plug is mounted at the rear of said torpedo housing between said propeller shaft and said outer perimeter hydrodynamic surface, and forward of said propeller.

8. A marine drive comprising a lower gearcase with a vertical drive shaft driving a horizontal propeller shaft in a torpedo housing having a front and a rear and having a propeller mounted on said propeller shaft at the rear of said torpedo housing, said torpedo housing having an internal cavity holding lubricant, said lubricant having an upper surface at a given level in said lower gearcase, said torpedo housing having an exterior hydrodynamic surface along which water flows, a removable drain plug mounted to said torpedo housing at a location away from said hydrodynamic surface to prevent cavitation burns, removal of said drain plug permitting draining of said lubricant, a vent plug having a discharge condition to discharge lubricant from said internal cavity such that said given level of lubricant in said lower gearcase is substantially at the top of said torpedo housing, said vent plug being located at said torpedo housing, wherein said drain plug and said vent plug are at the rear of said torpedo housing and are distally opposite each other.

9. The marine drive according to claim 8 wherein:

said torpedo housing has a top and a bottom;

said drain plug is proximate the bottom of said torpedo housing; and said vent plug is proximate the top of said torpedo housing.

10. A method for reducing heat, power loss and foaming of lubricant in a marine drive having a lower gearcase with a vertical drive shaft driving a horizontal propeller shaft in a torpedo housing having a front and a rear and having a propeller mounted on said propeller shaft at the rear of said torpedo housing, said torpedo housing having a top and a bottom and an internal cavity holding lubricant, said lubricant having an upper surface at a given level in said lower gearcase, said lower gearcase having a drive shaft housing portion extending upwardly from the top of said torpedo housing, said method comprising providing a vent plug having a discharge condition to discharge lubricant from said internal cavity such that said given level of lubricant in said lower gearcase is substantially at the top of said torpedo housing, and locating said vent plug at said torpedo housing.

11. The method according to claim 10 comprising locating said vent plug at the rear of said torpedo housing proximate the top thereof to lower the level of lubricant in said gearcase to be substantially at the top of said torpedo housing and below said drive shaft housing portion.

12. The method according to claim 11 wherein said torpedo housing has an exterior hydrodynamic surface along which water flows, and comprising locating said vent plug at the rear of said torpedo housing proximate the top thereof and at a location away from said hydrodynamic surface to prevent cavitation burns.

13. A method for filling a torpedo housing of a marine drive with lubricant, said torpedo housing having a front and a rear, said marine drive having a lower gearcase with a vertical drive shaft driving a horizontal propeller shaft in said torpedo housing and having a propeller mounted on said propeller shaft at the rear of said torpedo housing, said torpedo housing having a top and a bottom and an internal cavity for holding lubricant, said lower gearcase having a drive shaft housing portion extending upwardly from the top of said torpedo housing, said torpedo housing having a drain plug and a vent plug, said method comprising removing both said drain plug and said vent plug leaving respective exposed drain and vent ports in said torpedo housing, introducing lubricant through said drain port into said internal cavity in said torpedo housing and filling said torpedo housing with lubricant until the lubricant flows out of said vent port and without filling said drive shaft housing portion with said lubricant.

14. The method according to claim 13 wherein said drain plug is proximate the bottom of said torpedo housing, and said vent plug is proximate the top of said torpedo housing.

15. The method according to claim 13 wherein said torpedo housing includes a bearing carrier mounted therein and supporting said propeller shaft for rotation, and each of said drain plug and said vent plug engages said bearing carrier in threaded relation at the rear thereof, and comprising removing said drain plug by turning said drain plug out of said threaded engagement with said bearing carrier, and removing said vent plug by turning said vent plug out of said threaded engagement with said bearing carrier.

* * * * *